US008268414B2

(12) United States Patent
Tran et al.

(10) Patent No.: US 8,268,414 B2
(45) Date of Patent: Sep. 18, 2012

(54) INKJET ANTI-CURL COMPOSITIONS FOR MEDIA AND SYSTEMS FOR PROCESSING THE MEDIA

(75) Inventors: Hai Q Tran, San Diego, CA (US); Gary W Byers, Vista, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/945,591

(22) Filed: Nov. 12, 2010

(65) Prior Publication Data

US 2011/0059272 A1 Mar. 10, 2011

Related U.S. Application Data

(63) Continuation of application No. 11/105,882, filed on Apr. 13, 2005, now abandoned.

(51) Int. Cl.
*B41M 5/00* (2006.01)

(52) U.S. Cl. ..... 428/32.16; 428/32.17; 428/32.34

(58) Field of Classification Search ..... 428/32.16, 428/32.17, 32.34; 162/164.6, 181.2
See application file for complete search history.

(56) References Cited

U.S. PATENT DOCUMENTS

| | | | | |
|---|---|---|---|---|
| 3,503,700 | A * | 3/1970 | Griggs | 8/115.6 |
| 4,536,254 | A * | 8/1985 | Falk et al. | 162/135 |
| 4,554,181 | A | 11/1985 | Cousin et al. | |
| 5,356,464 | A | 10/1994 | Hickman et al. | |
| 5,746,814 | A | 5/1998 | Malhotra et al. | |
| 5,763,128 | A | 6/1998 | Malhotra | |
| 6,183,851 | B1 | 2/2001 | Mishima | |
| 6,500,215 | B1 | 12/2002 | Login et al. | |
| 2004/0033377 | A1 | 2/2004 | Koenig | |
| 2004/0178142 | A1* | 9/2004 | Koslow | 210/500.29 |
| 2005/0007431 | A1 | 1/2005 | Koyano et al. | |
| 2005/0084614 | A1 | 4/2005 | Bagwell et al. | |
| 2006/0028521 | A1 | 2/2006 | Frenkel | |

FOREIGN PATENT DOCUMENTS

| | | |
|---|---|---|
| EP | 1 502 760 A1 | 2/2005 |

OTHER PUBLICATIONS

Examiner's report No. 2 on patent application No. 2006237456, Australian Government, IP Australia, Oct. 18, 2010, 2 pages.

* cited by examiner

*Primary Examiner* — Betelhem Shewareged

(57) ABSTRACT

Briefly described, embodiments of this disclosure include print media and methods of preparing print media.

23 Claims, 6 Drawing Sheets

INKJET ANTI-CURL COMPOSITIONS FOR MEDIA AND SYSTEMS FOR PROCESSING THE MEDIA

CROSS REFERENCE TO RELATED APPLICATIONS

This application is a continuation of U.S. patent application Ser. No. 11/105,882, filed on Apr. 13, 2005 now abandoned.

BACKGROUND

Curl and cockle of cellulose-based papers are persistent problems in inkjet printing with water-based inks. The problem stems from dimensional changes in the paper when it is wetted (especially when it is wetted on only one side) and then dried. In normal plain paper, dimensional stability is a function of the presence of cellulose fibers, which are usually a couple of millimeters long. These bind together by fiber-to-fiber associations, which are dominated by intermolecular hydrogen (H) bonds.

When these fiber-to-fiber H-bonds are disrupted or broken, changes in paper physical integrity are brought about. This breaking can be brought about by exposure to elevated temperatures, H-bonding solvents (including water) and/or moisture/humidity.

When aqueous fluid (ink/fixer) is applied to paper, it first accumulates in the paper's capillary spaces. Water and other hydrophilic components of the fluid wet the surfaces of the fibers. This water and/or organic co-solvent breaks the fiber-to-fiber H-bond associations and noticeably reduces the paper's dimensional integrity. With continued exposure of the aqueous-co-solvent fluid to the fibers in the paper, the water and hydrophilic solvents penetrate into the amorphous regions of the cellulose and cause the fibers to swell.

With wetting, the cellulose fiber-to-fiber associations (H-bonds) are disrupted by water and as the fibers swell with water, they increase in size, which relocates the original sites for fiber-to-fiber associations. As the fibers begin to dry from the outside inward, their fiber-to-fiber H-bonds tend to reestablish as surface moisture is lost. As the fibers continue drying out, they shrink from their swollen state, and with the surface fiber-to-fiber associations reestablished, stress/strain develops. This stress/strain is observed as curl across the page.

SUMMARY

Briefly described, embodiments of this disclosure include print media and methods of preparing print media. One exemplary embodiment of the method of preparing print media, among others, includes: providing a print substrate; dispensing a fixative agent and an anti-curl composition onto the substrate, wherein the fixative agent includes a multi-valent salt and cationic salt, and wherein the anti-curl composition includes an amine oxide; achieving a load factor of about 0.1 gram per square meter (GSM) to 5 GSM of the fixative agent on the print substrate; and achieving a load factor of about 0.015 GSM to 2.69 GSM of the anti-curl composition on the print substrate.

One exemplary embodiment of the print medium, among others, includes: a print substrate; a fixative agent disposed on the substrate, wherein the fixative agent includes a multi-valent salt and a cationic polymer, wherein the fixative agents being disposed on the print substrate to achieve a load factor of about 0.1 gram per square meter (GSM) to 5 GSM; and an anti-curl composition disposed on the print substrate, wherein the anti-curl composition includes an amine oxide, and wherein the anti-curl composition being disposed on the print substrate to achieve a load factor of about 0.015 GSM to 2.69 GSM of the anti-curl composition on the print substrate.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Anti-curl compositions and fixative agents for print media and systems for processing the print media are provided. In general, the combination of fixative agents and an anti-curl composition is disposed on a print substrate. The fixative agent includes a multivalent salt such as calcium chloride and a cationic polymer such as a polyguanadine. The anti-curl composition includes one or more amine oxides. Use of the fixative agents and anti-curl composition reduces curling as compared to solutions in which these components are dispensed with an ink. The inclusion of these components on/within the substrate reduces cost because one less pen is needed in an inkjet system, and the complexity of the printer system is decreased as well. In addition, if the fixative agents and anti-curl compositions are dispensed at the same time as the ink, they can interact with the ink as they are dispensed, which can degrade print quality.

In particular, in order to minimize disruption of water interaction with the cellulose fibers a solvent (e.g., amine oxide) is added to the paper making process. The chemical nature of the solvent competes for fiber-to-fiber hydrogen bonding sites. Consequently, the dimensional changes caused by the swell of cellular fiber by the introduction of water are limited. Conversely, the solvent also limits the reformation of hydrogen bonding sites when the water evaporates from the cellulose fiber. Because new hydrogen bonding sites are not created, the structure of the cellulose fiber at the surface of the paper is the same as the internal fibers, and therefore a limited stress/strain state is created.

Figure 1:
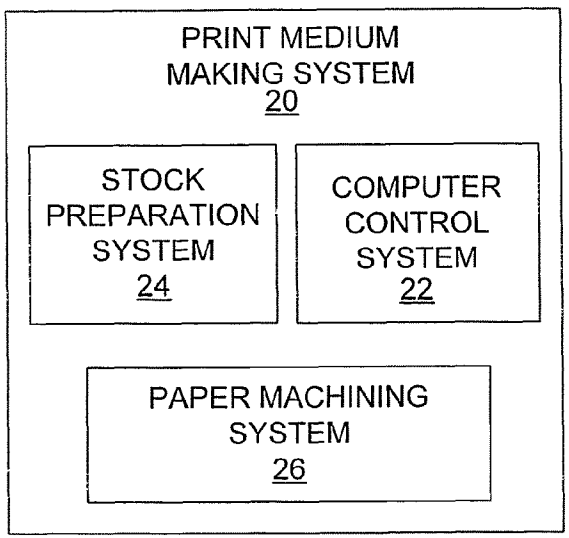
FIG. 1 is a representative embodiment of a print medium making system.

FIG. 1 illustrates a block diagram of a representative print medium making system 20 that includes, but is not limited to, a computer control system 22, stock preparation system 24, and a paper machining system 26. The computer control system 22 includes a process control system that is operative to control the stock preparation system 24 and the paper machining system 26. In particular, the computer control system 22 instructs and controls the introduction of an anti-curl composition into the paper machining system 26.

Figure 2:
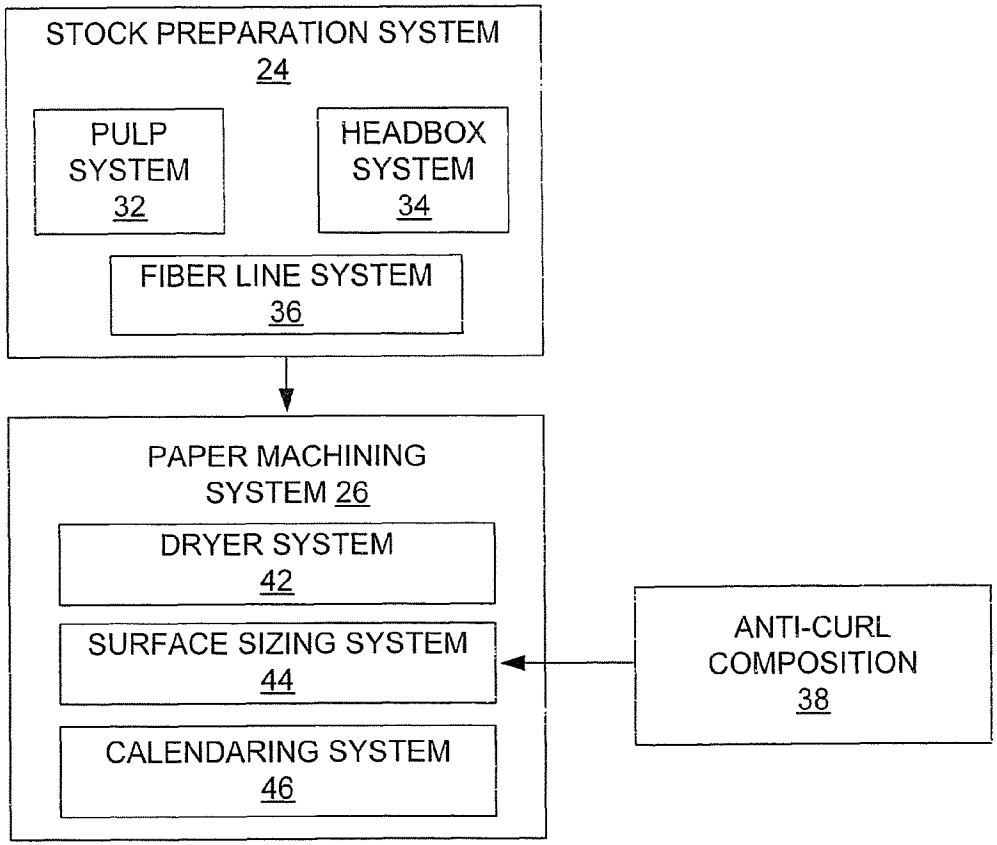
FIG. 2 is a representative embodiment of an aspect of the print medium making system illustrated in FIG. 1.

As shown in FIG. 2, the stock preparation system 24 includes, but is not limited to, a pulp system 32, a headbox system 34, and a fiber line system 36.

The pulp system 32 grinds wood stock into a fibrous material. The wood fibers are turned into the fibrous component (e.g., a fibrous pulp) with the addition of water and any other types of solvents in the headbox system 34. The addition of water and/or other solvents creates an emulsion of the fibrous component, which is easier to handle. The fibrous component is flattened into a preset thickness in the fiber line system 36. It should be noted that non-wood fibrous components, as described above, can be used to produce the print media and the use of wood stock is merely illustrative.

The paper machining system includes, but is not limited to a dryer system 42, a surface sizing system 44, and a calendaring system 46. The dryer system facilitates in evaporating water and other volatiles from the fibrous component. At the surface size system 44, additional surface sizing compound (e.g., starch, optical brighteners, and the like) can be added to the surface of the paper to achieve a final feel/texture and visual appeal of the print medium. Generally, the surface-sizing compound is an aqueous solution that is coated onto the paper. The calendaring tool is used to flatten the print medium to its final thickness as well as smooth the print medium. The fixative agents and the anti-curl composition can be added at the surface size press if it's incorporated into an aqueous solution along with other surface sizing components. The solution is easily dispersed into the fibrous component in liquid form and the water is evaporated off at a later stage, leaving the composition disposed within the fibrous component.

Figure 3:
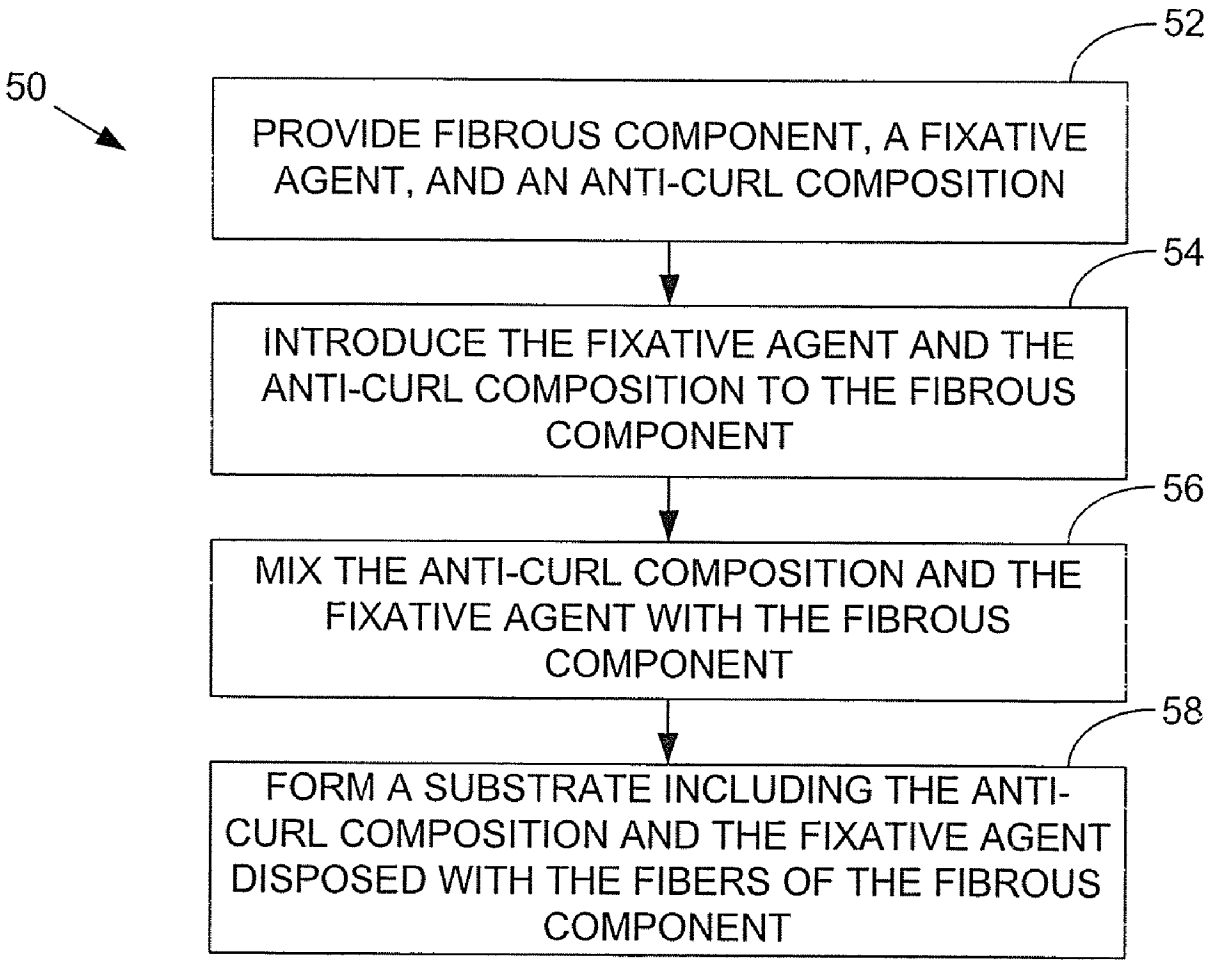
FIG. 3 is a representative flow diagram for an embodiment of a method of forming the print medium using the print medium making system of FIGS. 2 and 3.

FIG. 3 is a flow diagram describing a representative method 50 for making a print medium using the print medium making system 20. In block 52, the fibrous component, the fixative agents and the anti-curl composition are provided. In block 54, the fixative agents and the anti-curl composition are introduced to the fibrous component. The fixative agents and anti-curl composition can be introduced to the fibrous component at one or more steps of the print medium making process (e.g., during draw down or incorporated into the bulk slurry). In block 56, the fixative agents and anti-curl composition are mixed with the fibrous component. The fixative agents and anti-curl composition are disposed within and among the fibrous component and become an integral part of the substrate. In block 58, a substrate is formed, where the substrate includes the fixative agent and the anti-curl composition disposed, embedded, enmeshed, etc. within the fibers.

A print medium including the fixative agents and anti-curl composition can be used in a printer system, where a fluid (e.g., an ink, a dye-based ink and/or a pigment based ink) is dispensed onto the print medium. The printer system can be a laser printer system or an ink-jet printer system. For example, the ink-jet system includes, but is not limited to, ink-jet technologies and coating technologies, which dispense the ink onto the print media. Ink-jet technology, such as drop-on-demand and continuous flow ink-jet technologies, can be used to dispense the ink. The ink dispensing system can include at least one ink-jet printhead (e.g., thermal ink-jet printhead and/or a piezo ink-jet print head) operative to dispense (e.g., jet) the inks through one or more of a plurality of ink-jet printhead dispensers.

In general, the anti-curl composition includes, but is not limited to, amine oxides. Amine oxides have an oxygen anion and three groups (R1, R2, and R3) attached to a cationic nitrogen as shown below.

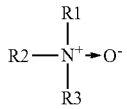

In general, each group independently can be H or an alkyl group. The alkyl groups can include up to 8 carbons. Furthermore, each alkyl group can be straight-chained, branched, cyclic (e.g., multiple alkyl groups can be combined into one or more ring structures), or combinations thereof. In addition, multiple alkyl groups connected to the nitrogen may be combined together to form 5- to 7-membered ring(s). Additionally, the alkyl groups may be substituted with or have attached to them groups, such as water solubilizing moieties. For example, one or more of the carbons in a 5- or 6-membered ring can be substituted with an oxygen atom, such as the ether group in a morpholine ring. Other examples include the attachment, rather than the substitution, of water solubilizing group(s) to alkyl group(s), that are straight-chained, branched, and/or 5 or 6-membered ring groups. As a non-limiting example, the water-solubilizing moiety might be a hydroxyl group, a carbonyl group, an amide group, a sulfone group, a sulfoxide group, a polyethylene glycol moiety, or an additional ammonium-N-oxide.

Non-limiting examples of amine oxides include: N-methylmorpholine-N-oxide (MMNO); N-ethylmorpholine-N-oxide (EMNO); N,N-dimethylbutylammonium-N-oxide (DMBANO); N,N,N-trimethylammonium-N-oxide (TMANO); N-methylpiperidine-N-oxide; N,N'-dimethylpiperazine-N,N'dioxide; N-methylazacylcoheptane-N-oxide; and 1,4-diazabicyclo[2,2,2]octane-1 ,4-dioxide.

The load factor of the anti-curling composition on the substrate can be from about 0.015 gram per square meter (GSM) to 2.69 GSM, about 0.015 GSM to 0.82 GSM, about 0.015 GSM to 0.67 GSM, about 0.015 GSM to 0.52 GSM, or about 0.52 GSM to 0.82 GSM.

The load factor is a function of, at least, the concentration of the amine oxide in the anti-curl composition and the manner in which the anti-curl composition is applied to the substrate. The load factors described above correspond to the concentration of the amine oxide in the anti-curl composition, and can range from about 0.1 to 20%, about 0.1 to 10%, about 0.1 to 6%, about 0.1 to 5%, about 0.1 to 4%, or about 4 to 6%. These concentrations of the anti-curl composition are applied using a draw down technique using a Meier rod #7 to achieve the load factors described above. The concentration and the manner in which the composition is applied to a substrate can be altered to achieve similar load factors.

The fixative agent is composed of a cationic polymer and a multi-valent salt. These fixative agents are also known as mordants. A mordant may be a cationic polymer such as, but not limited to, a polymer having a primary amino group, a secondary amino group, a tertiary amino group, a quaternary ammonium salt group, or a quaternary phosphonium salt group. The mordant may be in a water-soluble form or in a water-dispersible form, such as in latex.

The water-soluble cationic polymer can include, but is not limited to, a polyethyleneimine; a polyallylamine; a polyvinylamine; a dicyandiamide-polyalkylenepolyamine condensate; a polyalkylenepolyamine-dicyandiamideammonium condensate; a dicyandiamide-formalin condensate; an addition polymer of epichlorohydrin-dialkylamine; a polymer of diallyldimethylammoniumchloride ("DADMAC"); a copolymer of diallyldimethylammoniumchloride-$SO_2$, polyvinylimidazole, polyvinylpyrrolidone; a copolymer of vinylimidazole, polyamidine, chitosan, cationized starch, polymers of vinylbenzyl trimethylammonium chloride, (2-methacryloyloxyethyl)trimethyl-ammonium chloride, and polymers of dimethylaminoethylmethacrylate; or a polyvinylalcohol with a pendant quaternary ammonium salt. Examples of the water-soluble cationic polymers that are available in latex form and are suitable as mordants include, but are not limited to, TruDot P-2604, P-2606, P-2608, P-2610, P-2630, and P-2850 (available from MeadWestvaco Corp. (Stamford, Conn.)) and Rhoplex® Primal-26 (available from Rohm and Haas Co. (Philadelphia, Pa.)), WC-71 and WC-99 from PPG (Pittsburgh, Pa.), and Viviprint 200 and Viviprint 131 (available from ISP, (Wayne, N.J.)).

In another embodiment, the fixative agent includes a multivalent metallic salt. The metallic salts are soluble in water. The metallic salt can include cations such as, but not limited to, Group I metals, Group II metals, Group Ill metals, transition metals, or combinations thereof. In particular, the metallic cation can include, but is not limited to, sodium, calcium, copper, nickel, magnesium, zinc, barium, iron, aluminum, and chromium ions. In an embodiment, the metallic cation includes calcium, magnesium, and aluminum. The anion species can include, but is not limited to, chloride, iodide, bromide, nitrate, sulfate, sulfite, phosphate, chlorate, acetate ions, or combinations thereof.

The load factor of the fixative agent on the substrate can be from about 0.1 gram per square meter (GSM) to 5 GSM, about 0.1 GSM to 4 GSM, about 0.1 GSM to 3 GSM, about 0.1 GSM to 2 GSM, about 0.1 GSM to 1 GSM, about 0.3 GSM to 3 GSM, about 0.3 GSM to 2 GSM, or about 0.3 GSM to 1 GSM.

The load factor is a function of, at least, the concentration of the fixative agent and the manner in which the fixative agent is applied to the substrate. The concentrations of the fixative agent are applied using a draw down technique using a Meier rod #7 to achieve the load factor described above. One skilled in the art could alter the concentration and the manner in which the fixative agent is applied to a substrate to achieve similar load factors.

The terms "substrate", "print substrate", "print media", and/or "print medium" is meant to encompass a substrate based on cellulosic fibers. The substrate can be of any dimension (e.g., size or thickness) or form (e.g., pulp, wet paper, dry paper, etc.). The substrate is preferably in the form of a flat or sheet structure, which structure may be of variable dimensions (e.g., size and thickness). In particular, substrate is meant to encompass plain paper (e.g., inkjet printing paper, etc.), writing paper, drawing paper, photobase paper, and the like, as well as board materials such as cardboard, poster board, Bristol board, and the like. The print substrate can be from about 2 mils to about 12 mils thick, depending on a desired end application for the print medium.

The anti-curl composition can include other additives such as, but not limited to, microporous and/or mesoporous inorganic particles, and fillers. The additive is about 0% to 10% by weight of the mordant, about 0% to 20% by weight of the microporous and/or mesoporous inorganic particles, or about 0% to 20% by weight of fillers. In anti-curl composition including one or more additives, the additive is about 0.01% to 15% by weight of the anti-curl composition, about 0% to 10% by weight of the mordant, about 0% to 20% by weight of the microporous, and/or mesoporous inorganic particles, or about 0% to 20% by weight of fillers.

Typically, the microporous and/or mesoporous inorganic particles have a large surface area. The microporous and/or mesoporous inorganic particles can be bound in a polymer in the ink-receiving layer. The microporous and/or mesoporous inorganic particles can include, but are not limited to, silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudo-boehmite, bentonite, hectorite, clay, or mixtures thereof.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to 5%" should be interpreted to include not only the explicitly recited concentration of about 0.1 wt % to about 5 wt %, but also include individual concentrations (e.g., 1%, 2%, 3%, 4%, etc.) and the sub-ranges (e.g., 0.5%, 1.1%, 2.2%, 3.3%, 4.4%, etc.) within the indicated range.

EXAMPLE 1

Curl of dye based inkjet inks on paper that has amine oxides coupled with fixing agents:

Curl was measured by printing a rectangle of approximately 8 inch×10 inch of a primary color (cyan, magenta, yellow, or black) at 50% density where the color was laid down in a 4-pass print mode, for example. The printed page was set in a control ambient condition (25° C., 70% RH) and measurements were made at the end of 48 hours after printing to see how much of the edge of the media has lifted from the table. The maximum height was taken as the measurement for curl. Therefore, a high number is considered to be curled more than a low number.

Figure 4:
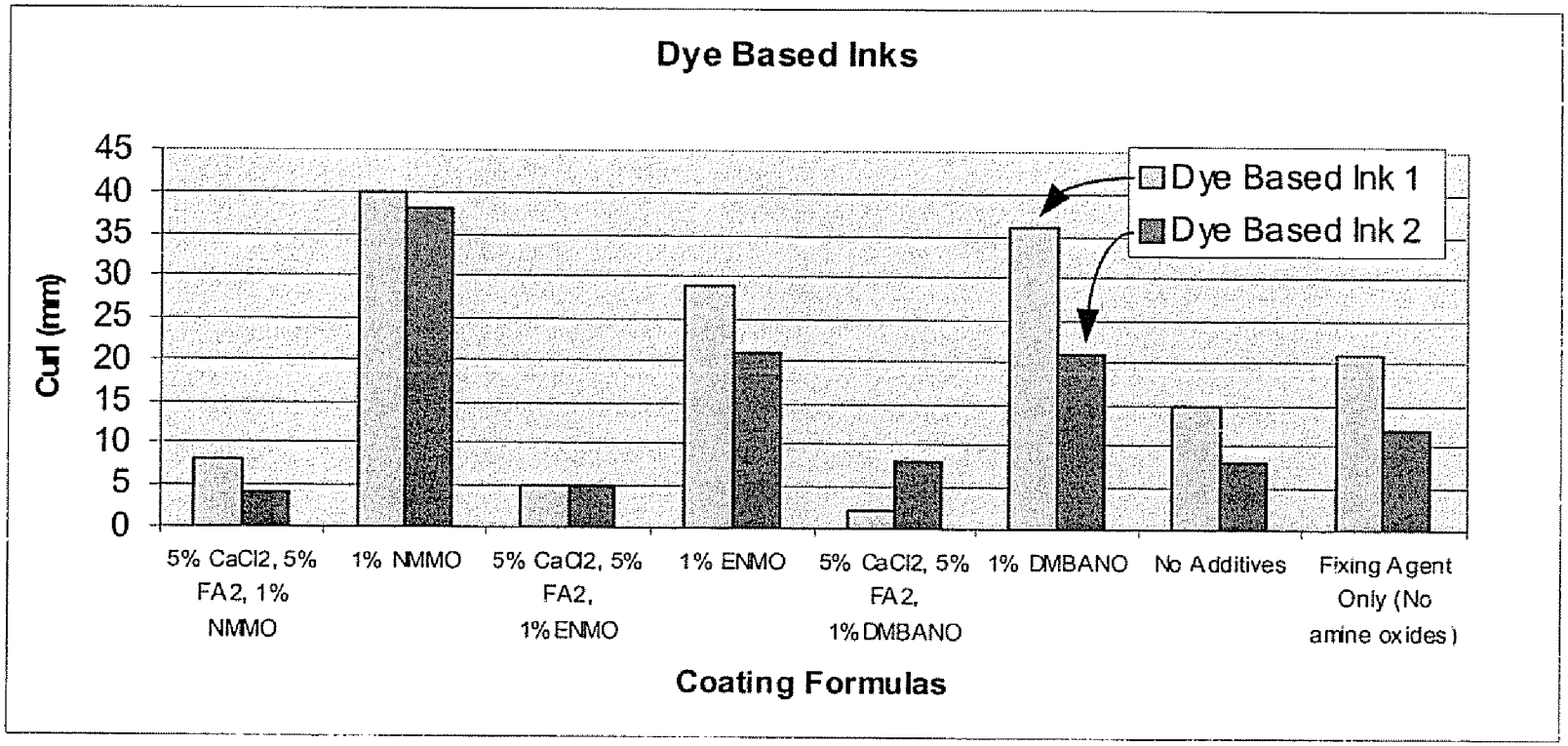
FIG. 4 illustrates a representative graph that shows using various inks with embodiments of fixative agents and anti-curling composition compared with the anti-curl composition only.

FIG. 4 illustrates a representative graph that shows using various inks with embodiments of the fixative agents and anti-curling composition compared with the anti-curl composition only.

Three different amine oxides were measured: N-methylmorpholine-N-oxide (MMNO); N-ethylmorpholine-N-oxide (EMNO); and N,N-dimethylbutylammonium-N-oxide (DMBANO). These amine oxides were used without the fixing agent and in combination of a fixing agent. As a comparison, paper with no additives and paper with fixing agent only were used as well. The amine oxides plus fixing agent performed best.

EXAMPLE 2

Curl of pigment based inkjet inks on paper that has amine oxides coupled with fixing agents:

Curl was measured by printing a rectangle of approximately 8 inch×10 inch of a primary color (cyan, magenta, yellow, or black) at 50% density where the color was laid down in a 4-pass print mode, for example. The printed page was set in a control ambient condition (25° C., 70% RH) and measurements were made at the end of 48 hours after printing to see how much of the edge of the media was lifted from the table. The maximum height was taken as the measurement for curl. Therefore, a high number is considered to be curled more than a low number.

Figure 5:
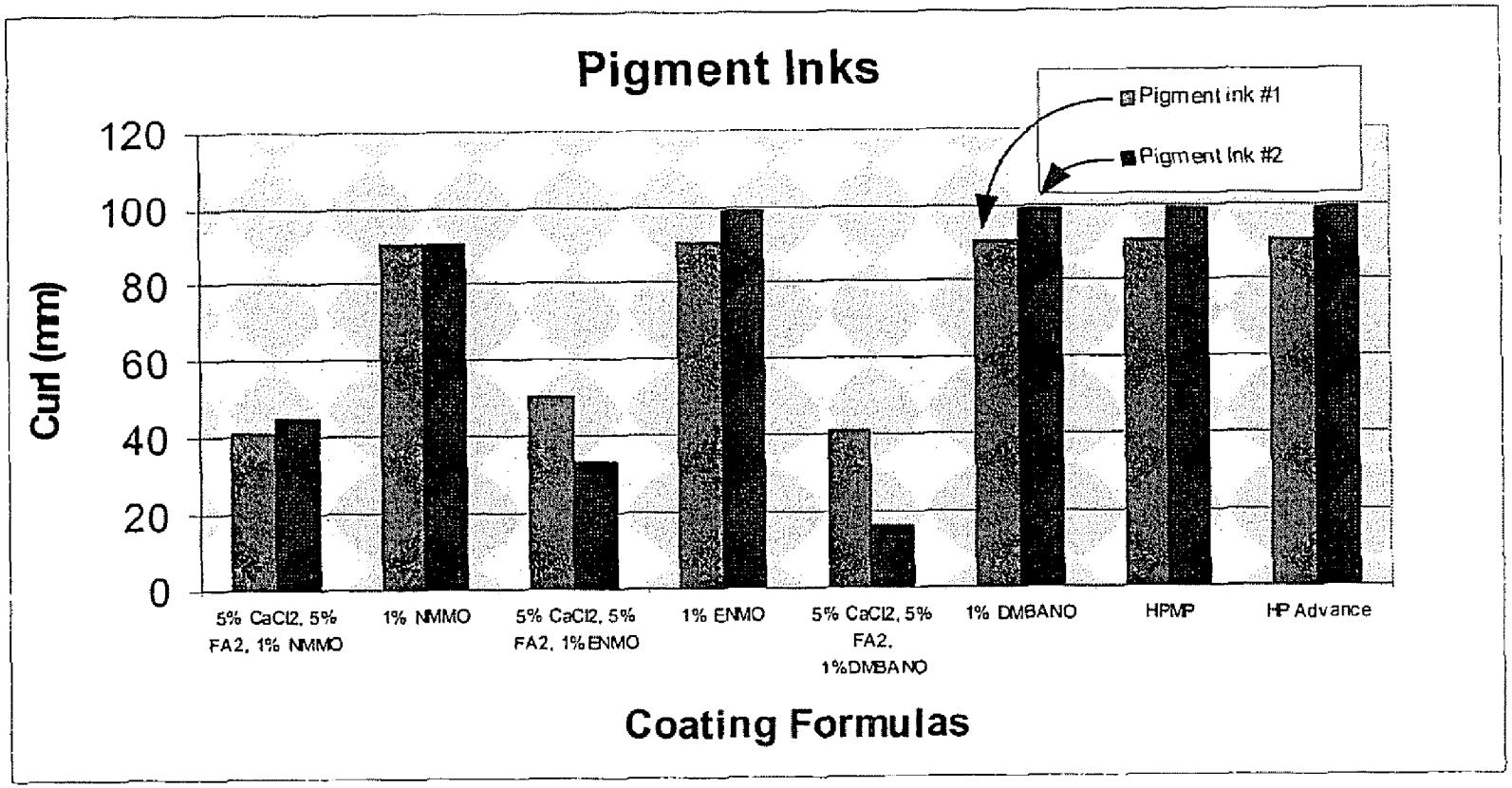
FIG. 5 illustrates a representative graph that shows that multivalent salts used in conjunction with the anti-curling agent reduce curl of pigment inks.

FIG. 5 illustrates a representative graph that shows that the multivalent salts used in conjunction with the anti-curling agent reduce curl of pigment inks.

Three different amine oxides were tested: N-methylmorpholine-N-oxide (MMNO); N-ethylmorpholine-N-oxide (EMNO); and N,N-dimethylbutylammonium-N-oxide (DMBANO). The amine oxides were used without the fixing agent and in combination of a fixing agent. As a comparison, paper with no additives and paper with fixing agent only were used as well. The amine oxides plus fixing agent performed best.

EXAMPLE 3

Curl of pigment/dye based inkjet inks on paper that has amine oxides coupled with fixing agents:

Curl was measured by printing a rectangle of approximately 8 inch×10 inch of a primary color (cyan, magenta, yellow, or black) at 50% density where the color was laid down in a 4-pass print mode, for example. The printed page was set in a control ambient condition (25° C., 70% RH) and measurements are made at the end of 48 hours after printing to see how much of the edge of the media has lifted from the table. The maximum height was taken as the measurement for curl. Therefore, a high number is considered to be curled more than a low number.

Figure 6:
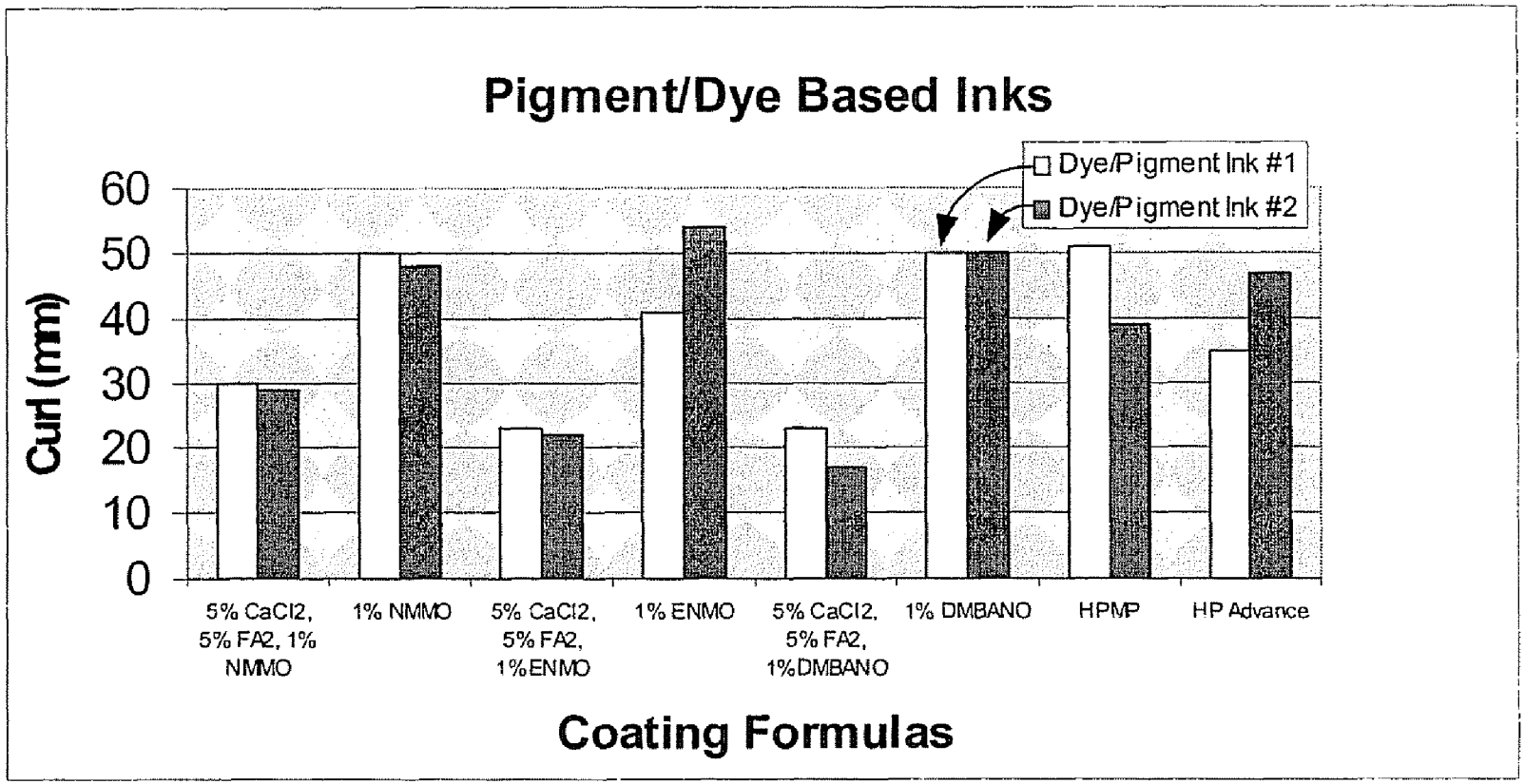
FIG. 6 illustrates a representative graph that shows that a cationic polymer used in conjunction with the anti-curling agent reduces curl of dye based inks.

FIG. 6 illustrates a representative graph that shows that the cationic polymer used in conjunction with the anti-curling agent reduces curl of dye based inks.

Three different amine oxides were tested: N-methylmorpholine-N-oxide (MMNO); N-ethylmorpholine-N-oxide (EMNO); and N,N-dimethylbutylammonium-N-oxide (DMBANO). The amine oxides were used without the fixing agent and in combination of a fixing agent. As a comparison, paper with no additives and paper with fixing agent only were used as well. The amine oxides plus fixing agent performed best.

EXAMPLE 4

Curl of pigment and dye based inkjet inks on paper that has amine oxides coupled with fixing agents at various concentrations of the amine oxide:

Curl was measured by printing a rectangle of approximately 8 inch×10 inch of a primary color (cyan, magenta, yellow, or black) at 50% density where the color was laid down in a 4-pass print mode, for example. The printed page was set in a control ambient condition (25° C., 70% RH) and measurements were made at the end of 96 hours after printing to see how much of the edge of the media has lifted from the table. The maximum height was taken as the measurement for curl. Therefore, a high number is considered to be curled more than a low number.

Figure 7:
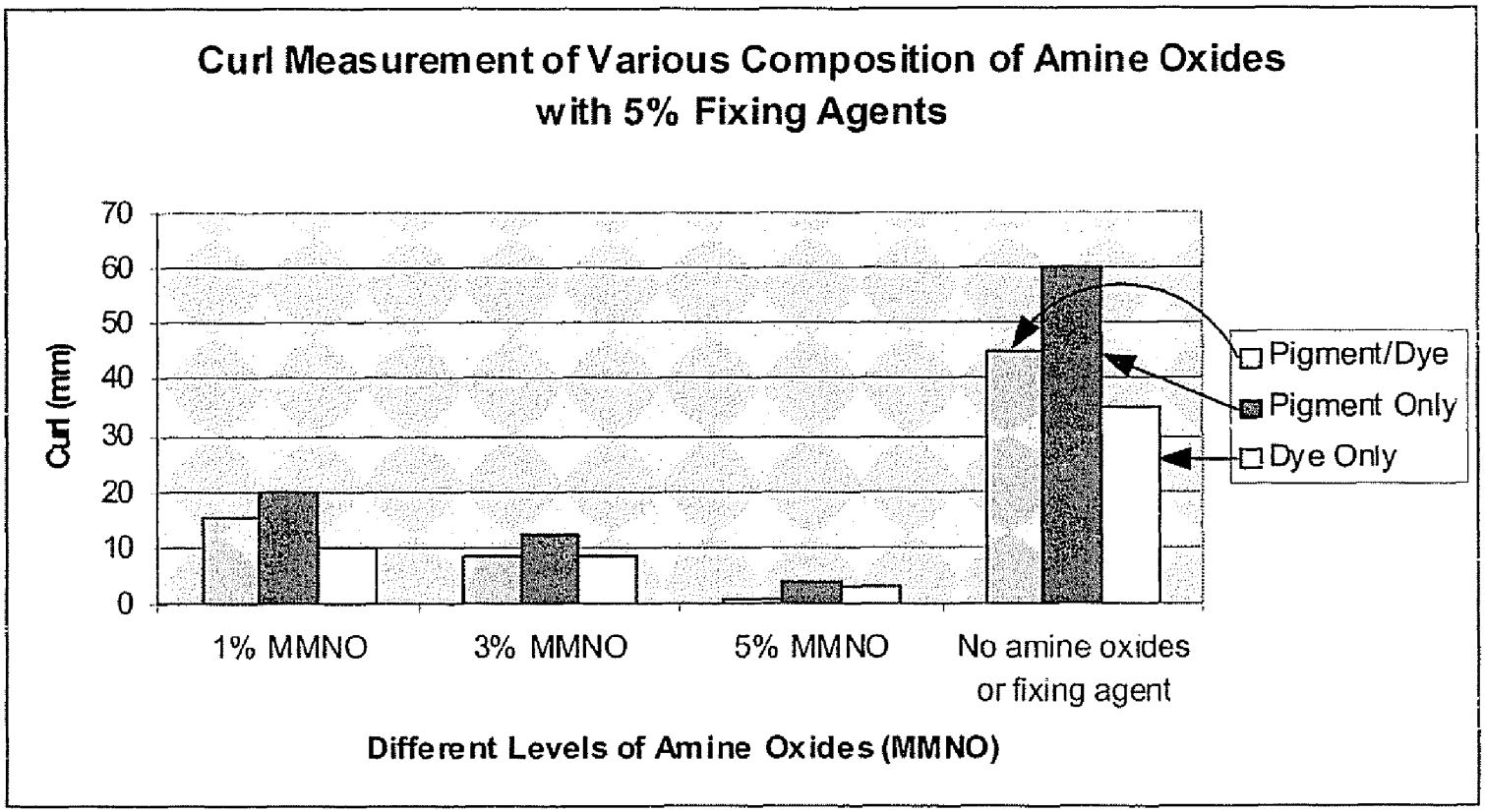
FIG. 7 illustrates a representative graph that shows the curl of paper of pigment and dye based inkjet inks that has amine oxides coupled with fixing agents at various concentrations of the amine oxide.

FIG. 7 illustrates a representative graph that shows the curl of pigment and dye based inkjet inks on paper that has amine oxides coupled with fixing agents at various concentrations of the amine oxide.

In this case, only N-methylmorpholine-N-oxide (MMNO) was used at various weight percentages and in combination with fixing agents. As a comparison, paper with no additives was used. The higher concentration of amine oxides performed best.

Many variations and modifications may be made to the above-described embodiments. All such modifications and variations are intended to be included herein within the scope of this disclosure and protected by the following claims.

At least the following is claimed:

1. A print medium, comprising:

a paper print substrate composed of cellulosic fibers;

a fixative agent incorporated into the paper print substrate such that the fixative agent is disposed among the cellulosic fibers, wherein the fixative agent includes a multivalent salt and a cationic polymer, wherein the multivalent salt includes a metallic cation and an anion, wherein the metallic cation is chosen from: sodium, calcium, copper, nickel, magnesium, zinc, barium, iron, aluminum, and chromium ions, wherein the anion is chosen from: chloride, iodide, bromide, nitrate, sulfate, sulfite, phosphate, chlorate, and acetate ions, wherein the fixative agent is disposed on the paper print substrate to achieve a load factor of about 0.1 gram per square meter (GSM) to 5 GSM; and an anti-curl composition incorporated into the paper print substrate such that the anti-curl composition is disposed among the cellulosic fibers, wherein the anti-curl composition includes an amine oxide, and wherein the anti-curl composition achieves a load factor of about 0.015 GSM to 2.69 GSM of the anti-curl composition on the paper print substrate, wherein the amine oxide is chosen from a compound having the following formula:

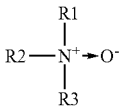

wherein R1, R2, and R3 are each individually selected from H and an alkyl group, and wherein the alkyl is a linear $C_1$ to $C_6$ alkyl group;

and wherein the curl of the print medium is less than or equal to 8 mm when printed on by a dye based ink, wherein the curl of the print medium is less than or equal to 50 mm when printed on by a pigment based ink, and wherein the curl is less than or equal to 30 mm when printed on by a combination of dye based ink and pigment based ink.

2. The print medium of claim 1, wherein the paper print substrate is chosen from plain paper, photobase paper, drawing paper, writing paper, and board materials.

3. The print medium of claim 1, wherein the load factor is about 0.015 GSM to 1.34 GSM for the anti-curling composition, and about 0.1 GSM to 3 GSM for the fixative agent.

4. The print medium of claim 1, wherein the load factor is about 0.015 GSM to 0.82 GSM for the anti-curling composition, and about 0.1 GSM to 3 GSM for the fixative agent.

5. The print medium of claim 1, wherein the load factor is about 0.015 GSM to 0.67 GSM for the anti-curling composition, and about 0.1 GSM to 3 GSM for the fixative agent.

6. The print medium of claim 1, wherein the load factor is about 0.015 GSM to 0.52 GSM for the anti-curling composition, and about 0.1 GSM to 2 GSM for the fixative agent.

7. The print medium of claim 1, wherein the load factor is about 0.52 GSM to 0.82 GSM for the anti-curling composition, and about 0.1 GSM to 1 GSM for the fixative agent.

8. A print medium for inkjet printing, comprising:

a paper print substrate composed of cellulosic fibers;

a fixative agent incorporated into the paper print substrate such that the fixative agent is disposed among the cellulosic fibers, wherein the fixative agent includes:

a multi-valent salt including a metallic cation chosen from sodium, calcium, copper, nickel, magnesium, zinc, barium, iron, chromium, and aluminum ions, and an anion chosen from chloride, iodide, bromide, nitrate, sulfate, sulfite, phosphate, chlorate, and acetate ions; and a cationic polymer chosen from a polyethyleneimine, a polyallylamine, a polyvinylamine, a dicyandiamide-polyalkylenepolyamine condensate; a polyalkylene-polyamine-dicyandiamideammonium condensate; a dicyandiamide-formalin condensate; an addition polymer of epichlorohydrin-dialkylamine; polyvinylimidazole, polyvinylpyrrolidone; a copolymer of vinylimidazole, polyamidine, chitosan, cationized starch, a polymer of vinylbenzyl trimethylammonium chloride, (2-methacryloyloxyethyl)trimethyl-ammonium chloride, a polymer of dimethylaminoethyl-methacrylate, and a polyvinylalcohol with a pendant quaternary ammonium salt;

wherein the fixative agent is disposed on the paper print substrate to achieve a load factor of about 0.1 gram per square meter (GSM) to 5 GSM; and an anti-curl composition incorporated into the paper print substrate such that the anti-curl composition is disposed among the cellulosic fibers, wherein the anti-curl composition includes an amine oxide, wherein the anti-curl composition achieves a load factor of about 0.015 GSM to 2.69 GSM of the anti-curl composition on the paper print substrate, wherein the amine oxide is selected from a compound having the following formula:

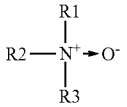

wherein R1, R2, and R3 are each individually selected from H and an alkyl group, and wherein the alkyl is a branched $C_1$ to $C_6$ alkyl group.

9. The print medium of claim 8, wherein the paper print substrate is chosen from plain paper, photobase paper, drawing paper, writing paper, and board materials.

10. The print medium of claim 8, wherein the load factor is about 0.015 GSM to 1.34 GSM for the anti-curling composition, and about 0.1 GSM to 3 GSM for the fixative agent.

11. The print medium of claim 8, wherein the load factor is about 0.015 GSM to 0.82 GSM for the anti-curling composition, and about 0.1 GSM to 3 GSM for the fixative agent.

12. The print medium of claim 8, wherein the load factor is about 0.015 GSM to 0.67 GSM for the anti-curling composition, and about 0.1 GSM to 3 GSM for the fixative agent.

13. The print medium of claim 8, wherein the load factor is about 0.015 GSM to 0.52 GSM for the anti-curling composition, and about 0.1 GSM to 2 GSM for the fixative agent.

14. The print medium of claim 8, wherein the load factor is about 0.52 GSM to 0.82 GSM for the anti-curling composition, and about 0.1 GSM to 1 GSM for the fixative agent.

15. The print medium of claim 8, wherein the curl of the print medium is less than or equal to 8 mm when printed on by a dye based ink, wherein the curl of the print medium is less than or equal to 50 mm when printed on by a pigment based ink, and wherein the curl is less than or equal to 30 mm when printed on by a combination of dye based ink and pigment based ink.

16. A print medium for inkjet printing, comprising:

a paper print substrate composed of cellulosic fibers;

a fixative agent incorporated into the paper print substrate such that the fixative agent is disposed among the cellulosic fibers, wherein the fixative agent includes calcium chloride and a cationic polymer, and wherein the fixative agent is disposed on the paper print substrate to achieve a load factor of about 0.1 gram per square meter (GSM) to 5 GSM; and an anti-curl composition incorporated into the paper print substrate such that the anti-curl composition is disposed among the cellulosic fibers, wherein the anti-curl composition includes an amine oxide, and wherein the anti-curl composition achieves a load factor of about 0.015 GSM to 2.69 GSM of the anti-curl composition on the paper print substrate, wherein the amine oxide is selected from N-methylmorpholine-N-oxide (MMNO), N-ethylmorpholine-N-oxide (EMNO), and N,N-dimethylbutylammonium-N-oxide (DMBANO);

wherein:

the curl of the print medium is reduced by at least 4 mm when printed on by a dye based ink, compared to an other print medium;

the curl of the print medium is reduced by at least 40 mm when printed on by a pigment based ink, compared to the other print medium;

the curl of the print medium is reduced by at least 5 mm when printed on by a combination of dye based ink and pigment based ink, compared to the other print medium; and the other print medium has the same composition as the print medium but i) does not include the anti-curl composition, ii) does not include the fixative agent, or iii) both i) and ii).

17. The print medium of claim 16, wherein the paper print substrate is chosen from plain paper, photobase paper, drawing paper, writing paper, and board materials.

18. The print medium of claim 16, wherein the load factor is about 0.015 GSM to 1.34 GSM for the anti-curling composition, and about 0.1 GSM to 3 GSM for the fixative agent.

19. The print medium of claim 16, wherein the load factor is about 0.015 GSM to 0.82 GSM for the anti-curling composition, and about 0.1 GSM to 3 GSM for the fixative agent.

20. The print medium of claim 16, wherein the load factor is about 0.015 GSM to 0.67 GSM for the anti-curling composition, and about 0.1 GSM to 3 GSM for the fixative agent.

21. The print medium of claim 16, wherein the load factor is about 0.015 GSM to 0.52 GSM for the anti-curling composition, and about 0.1 GSM to 2 GSM for the fixative agent.

22. The print medium of claim 16, wherein the load factor is about 0.52 GSM to 0.82 GSM for the anti-curling composition, and about 0.1 GSM to 1 GSM for the fixative agent.

23. The print medium of claim 16, wherein the curl of the print medium is less than or equal to 8 mm when printed on by a dye based ink, wherein the curl of the print medium is less than or equal to 50 mm when printed on by a pigment based ink, and wherein the curl is less than or equal to 30 mm when printed on by a combination of dye based ink and pigment based ink.

* * * * *